US010941946B2

(12) United States Patent
Jung et al.

(10) Patent No.: US 10,941,946 B2
(45) Date of Patent: Mar. 9, 2021

(54) OVEN EQUIPPED WITH AUTOMATICALLY ASCENDING/DESCENDING TRAY

(71) Applicant: LG ELECTRONICS INC., Seoul (KR)

(72) Inventors: Hanjin Jung, Seoul (KR); Sang Woo Kim, Seoul (KR); Sooyeon Kim, Seoul (KR); Hang Bok Lee, Seoul (KR); Yu Na Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 87 days.

(21) Appl. No.: 16/290,143

(22) Filed: Mar. 1, 2019

(65) Prior Publication Data

US 2019/0271475 A1 Sep. 5, 2019

(30) Foreign Application Priority Data

Mar. 2, 2018 (KR) ..... 10-2018-0025025

(51) Int. Cl.
*F24C 15/16* (2006.01)

(52) U.S. Cl.
CPC ..... *F24C 15/16* (2013.01)

(58) Field of Classification Search
CPC ..... F24C 15/16
See application file for complete search history.

(56) References Cited

U.S. PATENT DOCUMENTS 2,919,691 A * 1/1960 Rinaldo ..... F24C 15/16 126/337 A
3,043,290 A * 7/1962 Smith ..... F24C 15/16 126/337 A
3,059,634 A * 10/1962 Brinkman ..... F24C 15/16 126/337 R
3,976,000 A * 8/1976 Oxel ..... A47J 37/0623 99/446
5,429,043 A * 7/1995 Becker ..... F24C 15/16 126/337 A (Continued)

FOREIGN PATENT DOCUMENTS

DE 102004042827 3/2006
EP 3276264 1/2018

(Continued)

OTHER PUBLICATIONS

Extended European Search Report in European Application No. 19160053.5, dated Jul. 17, 2019, 9 pages.

*Primary Examiner* — David J Laux
(74) *Attorney, Agent, or Firm* — Fish & Richardson P.C.

(57) ABSTRACT

An oven includes a rear panel that is located at a rear side of a cavity of the oven, a first tray frame configured to support an oven tray located in the cavity, a guide part that is located at a front surface of the rear panel at lateral sides of the rear panel, a moving rack comprising guide connection parts configured to engage with the guide part and a first frame connecting part configured to connect to the first tray frame, the moving rack being configured to move up and down along the guide part, and a rear cover that is located between the oven tray and the rear panel and that covers a first space accommodating the guide part from a second space accommodating the oven tray. At least a portion of the first frame connecting part is exposed outside of the rear cover.

20 Claims, 9 Drawing Sheets

(56) References Cited

U.S. PATENT DOCUMENTS

| | | | | |
|---|---|---|---|---|
| 5,938,959 | A * | 8/1999 | Wang | A47J 37/0623 126/20 |
| 9,097,429 | B2 * | 8/2015 | Nam | F24C 15/16 |
| 9,109,804 | B2 * | 8/2015 | Armstrong | A47B 57/10 |
| 9,297,539 | B2 * | 3/2016 | Ambrose | B23P 19/00 |
| 2012/0125312 | A1 * | 5/2012 | Nam | F24C 15/16 126/19 R |
| 2014/0026882 | A1 | 1/2014 | Ambrose et al. | |

FOREIGN PATENT DOCUMENTS

| | | |
|---|---|---|
| JP | S5754332 | 3/1982 |
| KR | 2019970010476 | 3/1997 |
| KR | 1020150141797 | 12/2015 |
| KR | 101688740 | 12/2016 |
| KR | 20170121892 | 11/2017 |
| WO | WO2013026789 | 2/2013 |
| WO | WO2017102247 | 6/2017 |

* cited by examiner

OVEN EQUIPPED WITH AUTOMATICALLY ASCENDING/DESCENDING TRAY

CROSS-REFERENCE TO RELATED APPLICATION

This application claims priority to and the benefit of Korean Patent Application No. 10-2018-0025025, filed on Mar. 2, 2018, the disclosure of which is incorporated herein by reference in its entirety.

TECHNICAL FIELD

The present disclosure relates to an oven and, more particularly, an oven including an ascending/descending structure configured to automatically adjust a height of a tray disposed in a cavity of the oven based on a type of food.

BACKGROUND

An oven is a cooking device that may cook food by circulating high-temperature air in a sealed space. The oven may include a tray on which food is placed therein. In some cases, A user may adjust a height of the tray in the sealed space (i.e., a cavity of the oven) based on a food item to be cooked.

For example, when a display of an oven shows information on an optimum height of a tray based on the type of selected food, the user may adjust the height of the tray referring to the information on the display.

In some cases, the user may draw the tray out of the cavity in a state where the door of the oven is open, place the tray at a height adequate for cooking the selected food with reference to the optimum height, and then operate the oven.

In some examples, a link structure may adjust a height of a tray in an oven based on a height corresponding to the radius of gyration of the link. In some cases with the link structure, the tray may not be placed at a height twice as long as a length of the link or more. Accordingly, the tray may be placed within a range of limited heights. In some cases, the link structure may takes a space in a cavity of the oven, which may reduce a cooking volume of the cavity. In some cases, the user may have to open the door of the oven and adjust a height of the tray manually.

In some examples, a rack and pinion structure may be disposed on a lateral surface of a cavity and operated by a gear box and an external synchronous motor to ascend and descend a tray in the cavity. With the rack and pinion structure, the tray may ascend and descend in a state where the door of the oven is closed. In some cases, the gear box and external synchronous motor may be installed on the lateral surface of the cavity, which may require an increase of the size of the oven while the width of the cavity does not increase.

In some examples, a built-in oven may include a tray that can ascend and descend according to a series of predetermined sequences by operation of a control panel. In an example oven in related art, illustrated in FIG. 12, may include a motor 16 and a pulley 15 that generate and deliver power of ascending and descending the tray and that are installed on a lateral surface of the cavity. In this case, the size of the oven increases while the width of the cavity does not increase.

In some examples, an ascending/descending structure for stably ascending and descending a tray may be installed on both sides of the tray (e.g., on both walls of the cavity). In some cases, the ascending/descending structure may include elements that are exposed in the cooking space. In some cases, foreign substances from food may be attached to the ascending/descending structure and contaminate the structure, which may cause an incorrect operation of the ascending/descending structure.

SUMMARY

The present disclosure describes an oven that has a structure for automatically ascending and descending a tray in a cavity with a door of the oven being closed and for stably ascending and descending the tray with an ascending/descending structure of the tray that is not disposed on the lateral surface of the cavity.

The present disclosure describes an oven that has a structure for automatically ascending and descending a tray in the cavity and for ensuring maximization of a volume of the cavity.

The present disclosure describes an oven that has a structure in which an ascending/descending structure for ascending and descending a tray in a cavity of the oven is prevented from being exposed, which may reduce an incorrect operation of the tray in the cavity caused by contamination of the ascending/descending structure.

According to one aspect of the subject matter described in this application, an oven includes: a rear panel that defines at least a portion of a cavity of the oven and that is located at a rear side of the cavity; a first tray frame configured to support an oven tray located in the cavity; a guide part that is located at a front surface of the rear panel at lateral sides of the rear panel; a moving rack comprising guide connection parts configured to engage with the guide part and a first frame connecting part configured to connect to the first tray frame, the moving rack being configured to move up and down along the guide part; and a rear cover that is located between the oven tray and the rear panel and that covers a first space accommodating the guide part from a second space accommodating the oven tray. At least a portion of the first frame connecting part is exposed outside of the rear cover.

Implementations according to this aspect may include one or more of the following features. For example, the first frame connecting part may extend laterally outward of the guide part. In some implementations, the guide part may include a ball screw that extends in a vertical direction, in which the ball screw has a first end connected to a driving device configured to rotate the ball screw and a second end connected to a support configured to rotatably support the ball screw. The guide connection parts may include a ball nut configured to engage with the ball screw. In some implementations, the support is fixed to the rear panel.

In some implementations, the guide part may include a first guide part that is located laterally inward of the first frame connecting part, and a second guide part that is located laterally inward of the first guide part and that is located rearward of the first guide part toward the rear panel. In some examples, the rear cover may include: a plate portion that extends in a direction parallel to the rear panel; and an inclined portion that is inclined relative to the plate portion, that extends in a direction forward and laterally outward from the plate portion, and that covers the first guide part and the second guide part.

In some implementations, the first frame connecting part may include a pair of connecting parts that are located at lateral sides of the moving rack, and the moving rack further may include a cross bar that extends between the pair of connecting parts in a lateral direction and that is connected to the pair of connecting parts. The rear cover may cover the cross bar of the moving rack. In some examples, the rear panel may define panel air holes, and the rear cover may define cover air holes at positions corresponding to the panel air holes.

In some implementations, the oven may further include a spacer located between the rear cover and the rear panel and configured to couple the rear cover to the rear panel. In some examples, the rear panel may include a first guider that extends in a vertical direction and that is located at the front surface of the rear panel, where the moving rack may include a second guider that is configured to move in the vertical direction along the first guider. In some examples, the first guider may be located rearward of the guide part.

In some implementations, the first frame connecting part may be located forward of the rear panel and spaced apart from the rear panel by a predetermined distance, and the oven further may include a fixed tray rack located between the rear panel and the first frame connecting part. In some examples, the fixed tray rack may be fixed to the rear panel, where at least a portion of the fixed tray rack is spaced apart from the rear panel and the first frame connecting part.

In some implementations, the fixed tray rack may include a second frame connecting part that is configured to detachably connect to a second tray frame and that is configured to support the second tray frame at predetermined positions that are spaced apart in a vertical direction. In some examples, the second frame connecting part defines fitting holes and is located rearward of the first frame connecting part, and the first frame connecting part may include a fixation member that extends rearward and that is configured to couple to the fitting holes of the second frame connecting part.

According to another aspect, a rear panel of an oven located at a rear side of a cavity of the oven includes: a guide part that is connected to the rear panel and that is located at a front surface of the rear panel at lateral sides of the rear panel; a moving rack comprising a frame connecting part configured to connect to an oven tray and guide connection parts configured to engage with the guide part, the moving rack being configured to move up and down along the guide part; and a rear cover that is connected to the rear panel and that covers a front side of the guide part.

Implementations according to this aspect may include one or more of the following features or the features described above. For example, the rear panel may further include a first guider that extends in a vertical direction, that is located at the front surface of the rear panel, and that is located rearward of the guide part, where the moving rack further may include a second guider that is configured to move in the vertical direction along the first guider.

In some implementations, the guide part may include: a first guide part that is located laterally inward of the frame connecting part; and a second guide part that is located laterally inward of the first guide part and that is located rearward of the first guide part toward the rear panel. In some examples, the frame connecting part may include a pair of connecting parts that are located at lateral sides of the moving rack, and the moving rack further may include a cross bar that extends between the pair of connecting parts in a lateral direction and that is connected to the pair of connecting parts. The rear cover covers the cross bar of the moving rack. In some examples, the frame connecting part may be located forward of the rear panel and spaced apart from the rear panel by a predetermined distance, and the rear panel may be located rearward of a fixed tray rack that is located rearward of the frame connecting part.

The present disclosure may minimize a space in the cavity, taken up by the ascending/descending structure of the tray.

The present disclosure may enable the ascending/descending structure of the tray to ascend and descend while stably supporting the tray.

The present disclosure may prevent the ascending/descending structure of the tray from being contaminated by foreign substances such as food, and the like, and allow air to circulate smoothly.

The structure of the present disclosure may be simplified and may be used in different aspects because a plurality of trays may be installed in the present disclosure, a part of the ascending/descending structure of the tray is used as a structure for installing another tray.

Effects of the present disclosure and the above-described effects will be described in the section of the detailed description.

DETAILED DESCRIPTION

The present disclosure will be described with reference to exemplary implementations and attached drawings.

The present disclosure may not be limited to the implementations described below, but may be implemented in various other forms. The implementations are presented so as to make the present disclosure thorough and complete and to convey the scope of the present disclosure to one having ordinary skill in the art completely.

Figure 1:
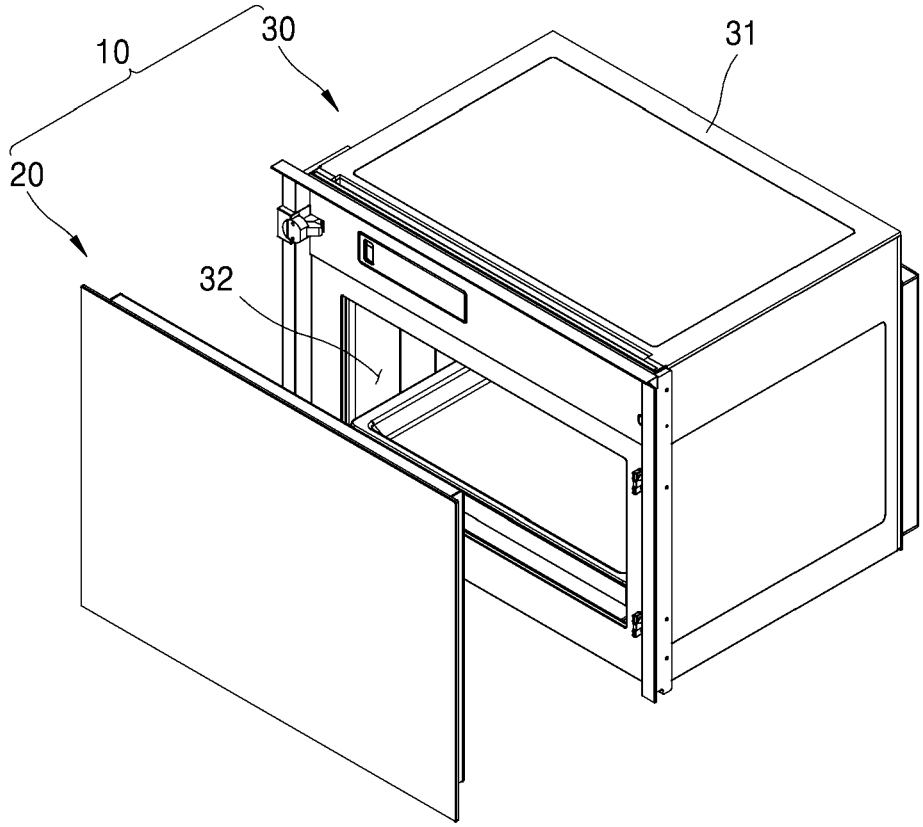
FIG. 1 is a perspective view illustrating an example oven in a state in which an example door of the oven is detached from the oven.
Figure 2:
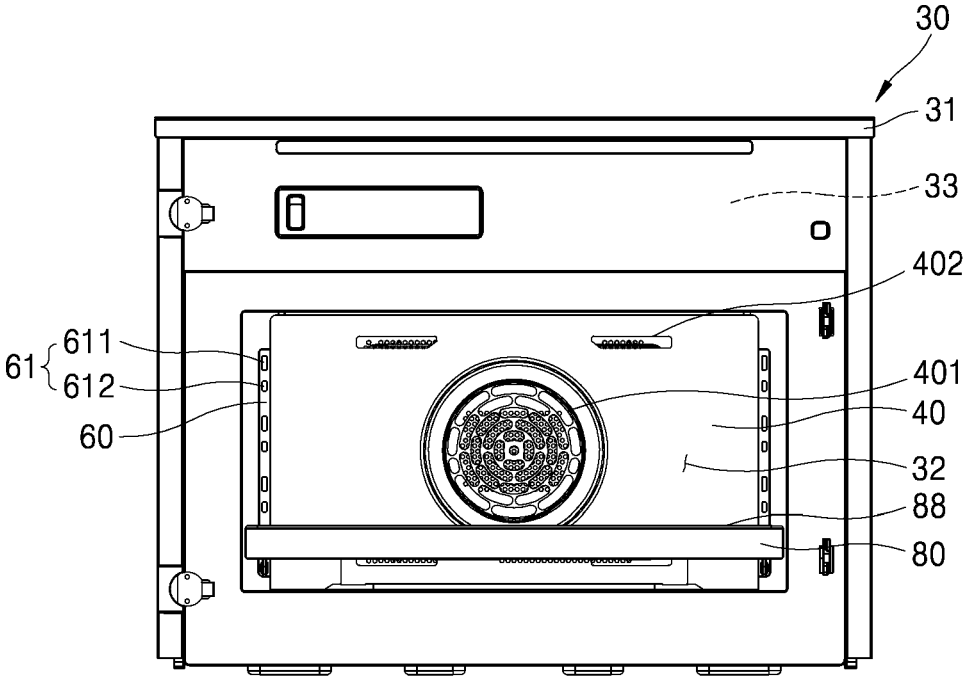
FIG. 2 is a front view illustrating an example oven in a state in which a door is removed from the oven.
Figure 3:
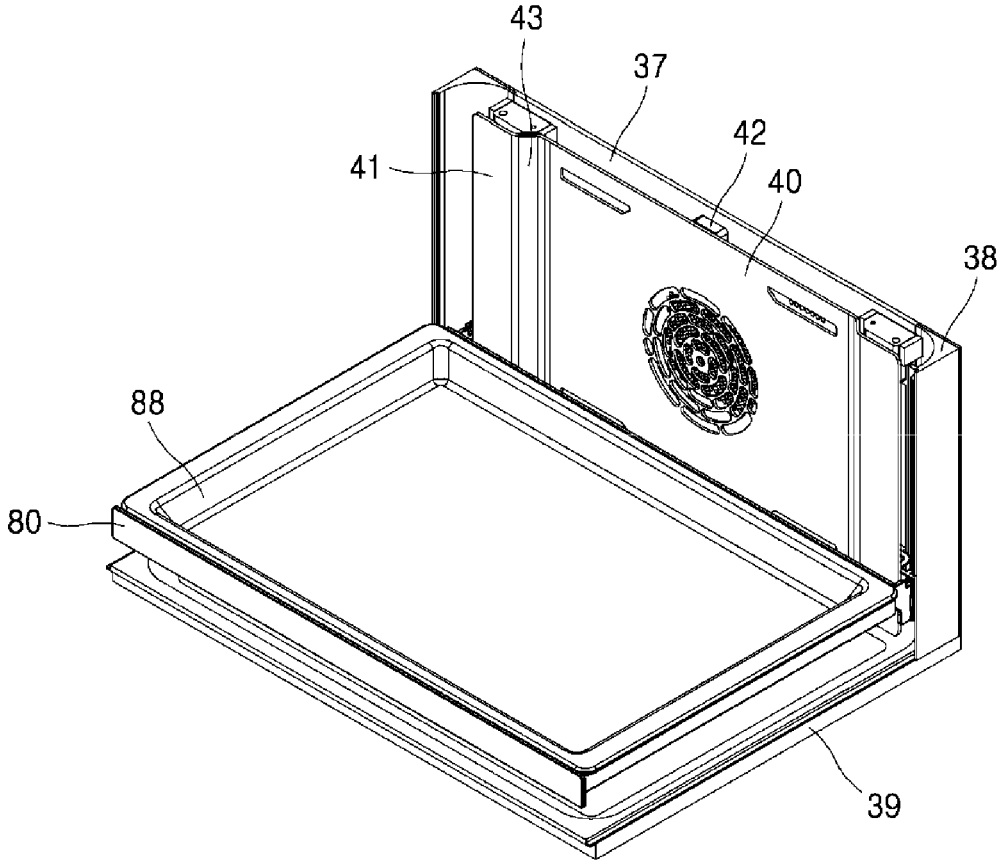
FIG. 3 is a perspective view illustrating an example cavity of an example oven in a state in which lateral walls and an upper wall are removed.
Figure 4:
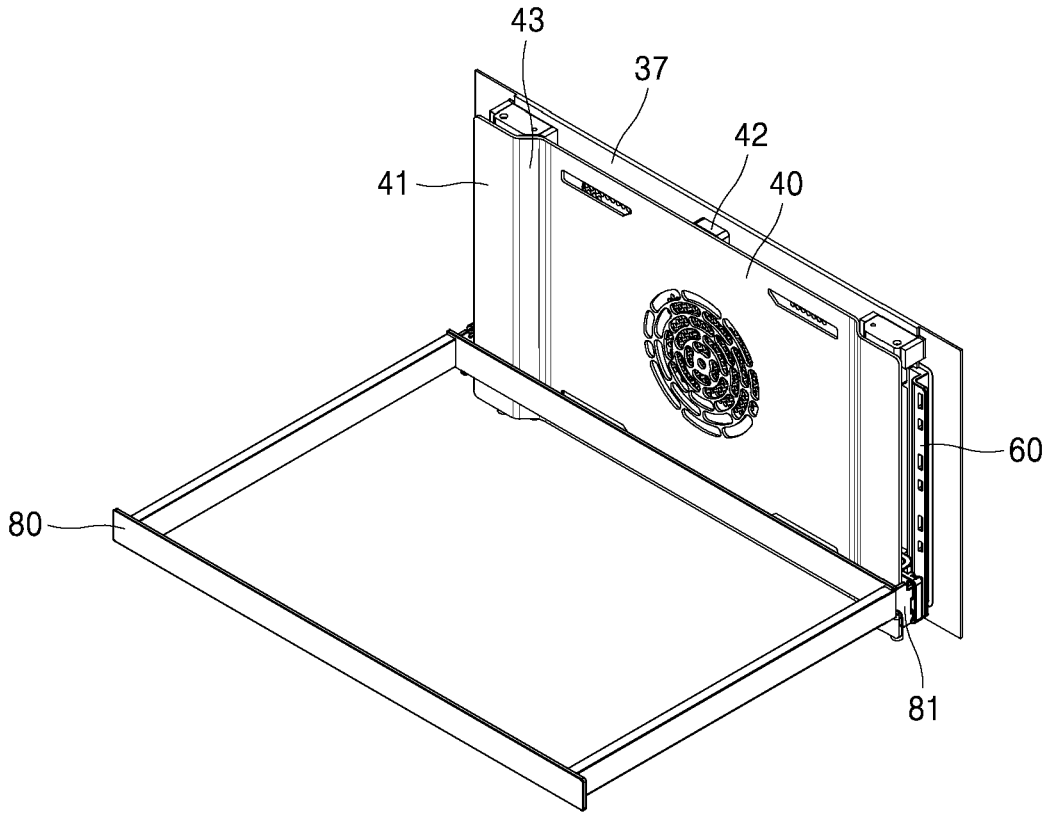
FIG. 4 is a perspective view illustrating the example oven in a state in which a first tray, a corner frame, and a floor panel of the oven in FIG. 3 are removed.
Figure 5:
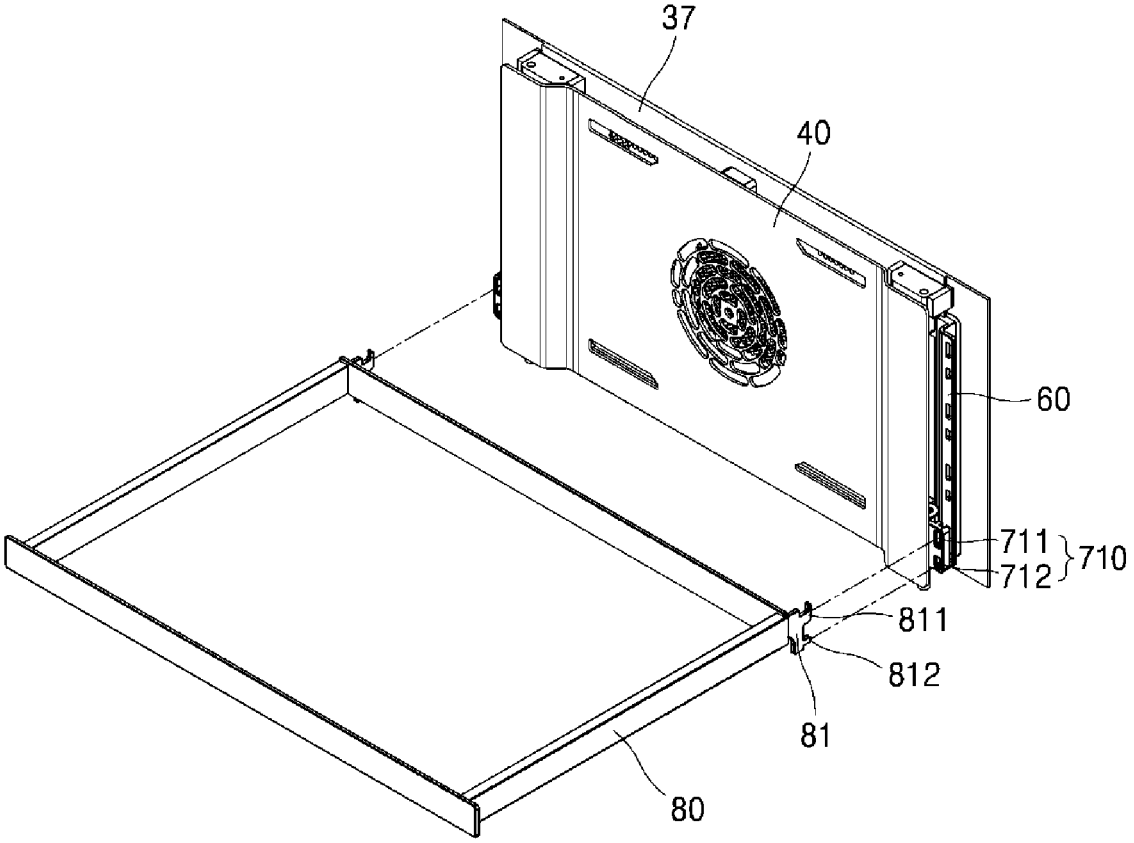
FIG. 5 is a perspective view illustrating the example oven in a state in which an example tray frame in FIG. 4 is detached.
Figure 6:
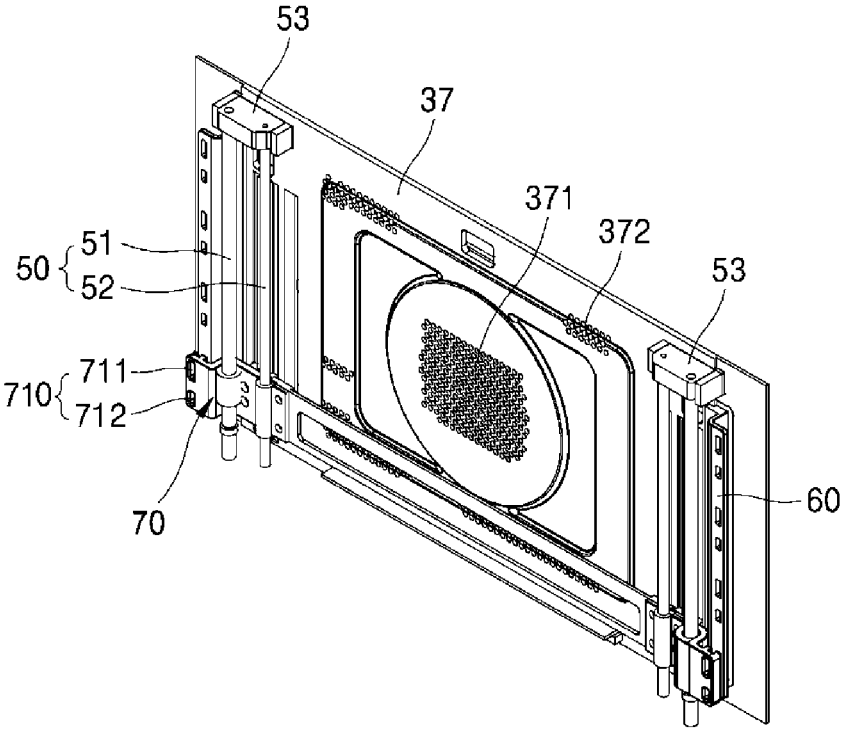
FIG. 6 is a perspective view illustrating the example oven in a state in which an example rear cover in FIG. 5 is removed.
Figure 7:
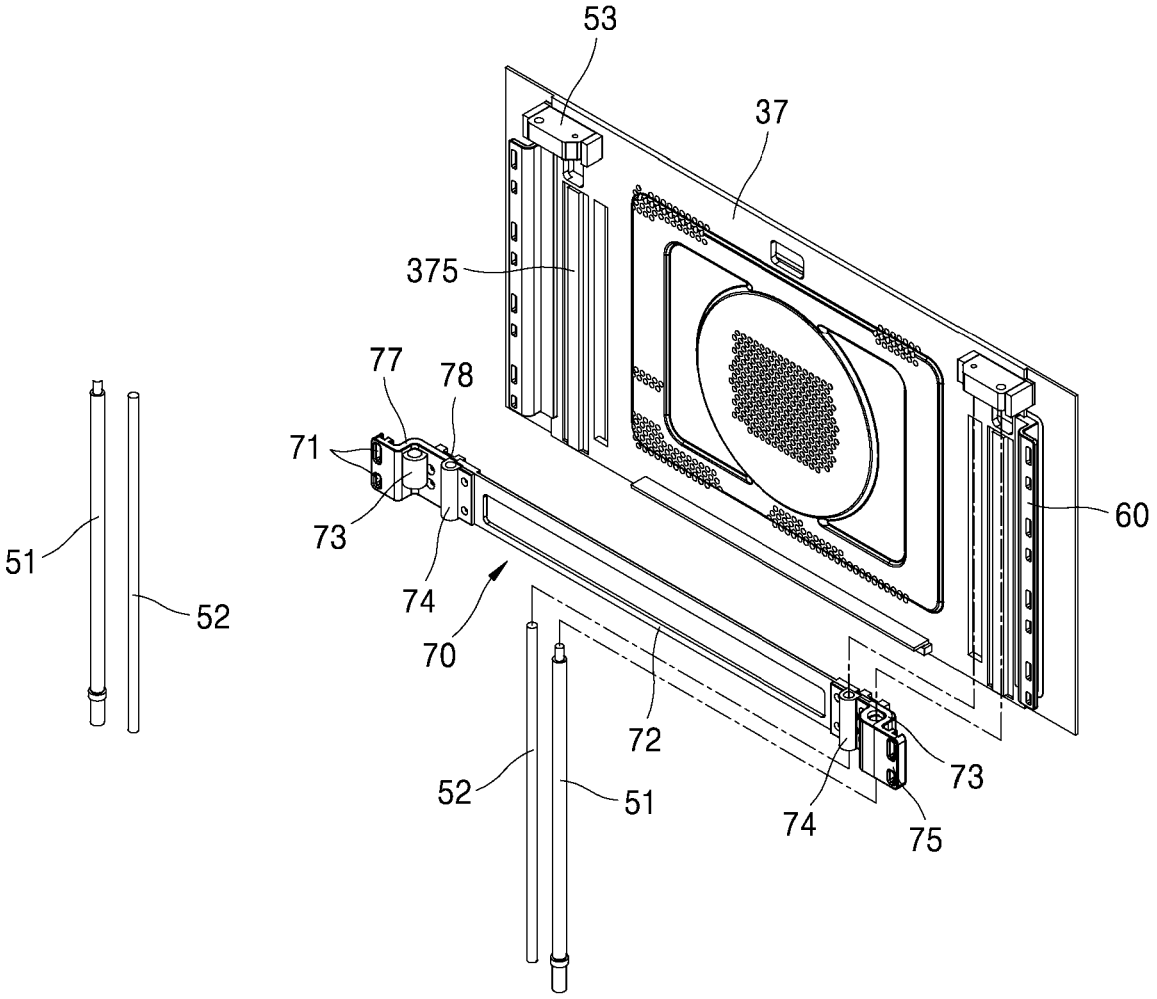
FIG. 7 is an exploded perspective view illustrating the example oven in a state in which an example ball screw and an example moving rack in FIG. 6 are detached.
Figure 8:
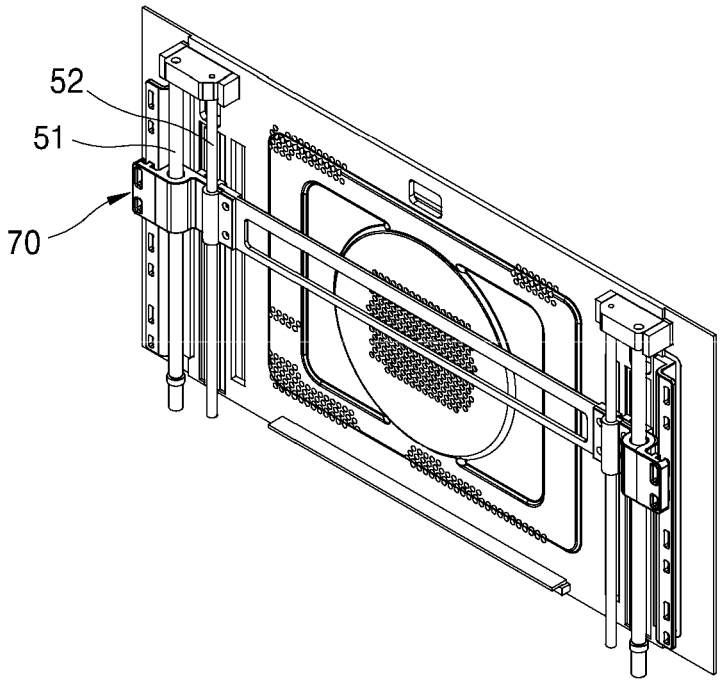
FIG. 8 is a perspective view illustrating the example oven in a state in which the moving rack is ascended by the ball screw in FIG. 6.
Figure 9:
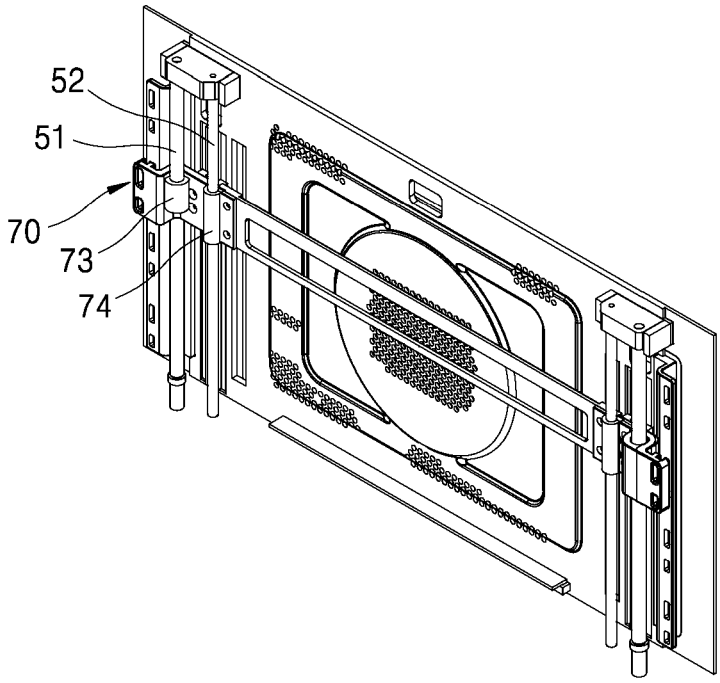
FIG. 9 is a perspective view illustrating an example ball nut built into the moving rack in FIG. 8 in a state in which a part of the moving rack is omitted.

Referring to FIGS. 1 to 3, an example oven 10 includes a main body 30 having a cavity 32 that is a space for accommodating and heating food and a door 20 provided at a front surface of the main body 30. A body 31 of the main body 30 includes a heater that heats food accommodated in the cavity 32, a fan, and the like, and the cavity 32 of the body 31 has an approximate cuboid-shaped space the front surface of which is open.

Various types of doors such as a pull-down door that swivels around a horizontal shaft of the lower portion of the door, a swing door that rotates around a perpendicular shaft of the left or the right of the door, and the like may be used as the door 20. When the door 20 is closed, the front opening of the cavity 32 is closed, and the inside of the cavity 32 is sealed up.

The cavity 32 includes a first tray 88 therein so as to place food on the first tray, and the first tray 88 is placed on a first tray frame 80 that may be drawn forward like a drawer. Accordingly, the user may open the door 20, draw the first tray frame 80, place food on the first tray 88 that is laid in the first tray frame 80 and put the first tray frame 80 into the cavity 32.

The cavity 32 includes air holes that introduce air heated by a heater, on a rear wall thereof, and a fan at the rear of the air hole rotates, such that air heated by the heater is introduced through the air holes into the cavity 32.

The body 31 of the main body includes an upper space 33 that accommodates a circuit board for controlling the operation of the oven, and the like in the upper portion of the cavity 32.

A structure for controlling a height of the first tray 88 in the cavity 32 will be described.

An ascending/descending structure of a tray will be described with reference to FIGS. 2 to 10.

The cavity includes a cavity floor panel 39 that defines a lower boundary surface of the cavity, on the bottom surface thereof and a cavity rear panel 37 that defines a rear boundary surface of the cavity, on the rear surface thereof.

The cavity rear panel 37 includes a corner frame 38 that has a streamlined curve so as to allow air circulating in the cavity to smoothly flow, in both end portions thereof. The corner frame 38 includes a curved surface with an approximately concave arc-shaped profile, as illustrated in the drawings.

The cavity floor panel 39 includes a first tray frame 80 and a first tray 88 in the upper portion thereof. The first tray frame 80 is configured to be ascended and descended by a driving device such as a motor, and the like. In this disclosure, the driving device and a driving force delivering device are provided at the rear of the cavity.

In some implementations, the driving device and the driving force delivering device may be located at the rear of a rear cover 40. The rear cover 40 prevents the driving device and the driving force delivering device from being contaminated by foreign substances that pop while food is cooked, takes up little space in the cavity and induces heat circulating in the cavity to smoothly flow.

The rear cover 40 is placed in parallel with the cavity rear panel 37 further forward than the cavity rear panel 37 and the rear cover is spaced a predetermined distance apart from the cavity rear panel by a spacer 42. The rear cover 40 may be integrally fixed to the cavity rear panel 37 by the spacer 42. When the cavity rear panel 37 is assembled to the main body 30 in the state where the rear cover 40 is fixed to the cavity rear panel 37 by the spacer 42, the rear cover may be easily installed in the cavity.

The rear cover 40 includes a central air hole 401 that discharges heat from the rear of the rear cover, at the central portion thereof and peripheral air holes 402 provided around the central air hole. The central air hole and the peripheral air holes are provided in positions corresponding to those of a central air hole 371 and peripheral air holes 372 in the cavity rear panel 37 so as to allow heat circulating via a fan at the rear of the cavity rear panel 37 to smoothly circulate.

The rear cover 40 has an approximately rectangular plate shape. The rear cover 400 has a height corresponding to that of the cavity rear panel 37 and has a width narrower than that of the cavity rear panel 37. Both end portions of a moving rack 70 on which the first tray frame 80 may be laid are exposed on both front sides of the cavity rear panel 37 that are exposed due to a difference in the width of the rear cover 40 and the cavity rear panel 37.

The moving rack 70 includes an upper fitting hole 711 that has the shape of a hole which is long in the up-down direction, in the upper portion of both end portions thereof and a lower fitting hole 712 that has the shape of an approximately round hole in the lower portion of the upper fitting hole 711. The upper fitting hole 711 and the lower fitting hole 712 constitutes a first tray frame connecting part 71 that connects with the first tray frame 80. A part, protruding further than the rear cover 40 and exposed to the outside, of the moving rack 70 is the first tray frame connecting part 71. The first tray frame connecting part 71 may be a structure where fitting holes 711, 712 are formed in a rack member 75.

In some implementations, the first tray frame 80 may have an approximate rectangular shape and include a rack coupling part 81 that is detachably coupled to the fitting hole 710, in both rear end portions thereof. The rack coupling part 81 includes a hook 811 and a protrusion 812 that extend backward, and the hook 811 is fitted into the upper fitting hole 711 while the protrusion 812 is fitted into the lower fitting hole 712.

When the hook 811 is fitted into the upper fitting hole 711, and the protrusion 812 is fitted into the lower fitting hole 712, a hanger of the hook is held in the rear surface of the moving rack 70 via the self-weight of the first tray frame 80, and the first tray frame 80 remains horizontal in the shape of a cantilever.

The self-weight of the first tray frame 80 and the first tray 88 that is placed in the first tray frame is applied as a moment to the first tray frame connecting part 71, and the present disclosure presents an ascending/descending structure that may support the moment properly so as to ascend and descend.

The moving rack 70 is formed as a cross bar 72 that extends in the left-right direction, both end portions of which includes the first tray frame connecting part 71 respectively. The cross bar 72 the central portion of which is open in the shape of a hole that is long in the left-right direction to the extent that interference with the flow of heat flowing through the central air hole 371 is minimized, that self-weight is reduced and that strength is maintained. The cross bar 72 is placed close to the cavity rear panel 37 and takes up little space in the cavity.

The first tray frame connecting part 71 is placed further forward than the cross bar 72. The first tray frame connecting part 71 is spaced apart from the cavity rear panel 37 further forward than the cross bar 72 so as to ensure a space at the rear of the first tray frame connecting part 71 and a space for the attachment and detachment of the first tray frame 80 and the first tray frame connecting part 71.

A first ascending/descending connection part 73 is placed further inward than the first tray frame connecting part 71 in the left-lateral and right-lateral directions. The first ascending/descending connection part 73 is fitted into a first ascending/descending guide part 51 that extends in the up-down direction.

A second ascending/descending connection part 74 is placed further inward and further backward than the first ascending/descending connection part 73 in the left-lateral and right-lateral directions. The second ascending/descending connection part 74 is fitted into a second ascending/descending guide part 52 that extends in the up-down direction.

The first ascending/descending connection part 73 and the second ascending/descending connection part 74 are spaced a predetermined distance apart in the front-rear direction and, accordingly, effectively support a moment applied to the moving rack 70 via the first tray 88 that is installed as a cantilever structure. The first ascending/descending connection part and the second ascending/descending connection part are also spaced a predetermined distance apart in the left-right direction. Accordingly, the positions of the first ascending/descending connection part and the second ascending/descending connection part may be partly overlapped in the front-rear direction. Thus, a distance between the first ascending/descending connection part and the second ascending/descending connection part may be shortened in the front-rear direction.

The moving rack 70 is placed further backward than the rear cover 40 so as not to interfere with the rear cover and placed further forward than the cavity rear panel 37 so as not to interfere with the cavity rear panel. That is, the moving rack 70 is placed between the rear cover and the cavity rear panel 37. When the rear cover 40 is placed closer to the cavity rear panel 37, the inner space of the cavity 32 becomes greater.

The moving rack 70 has the shape of a board that has a predetermined height and width and that stands. The first ascending/descending connection part 73 of the moving rack 70 is placed further forward than the second ascending/descending connection part 74 while not protruding further forward than the first tray frame connecting part 71, and the second ascending/descending connection part 74 is placed further backward than the first ascending/descending connection part 73 while not protruding further backward than the cross bar 72.

Specifically, in the moving rack 70, a bent part 77 where a board is bent is provided between the cross bar 72 and the first tray frame connecting part 71 such that the first tray frame connecting part is placed further forward than the cross bar, and the first ascending/descending connection part 73 may be placed further inward than the first tray frame connecting part 71 in the corner of a space that is ensured by the bent part 77 in the front-rear direction. When the first ascending/descending connection part 73 is placed in the corner of the bent part 77, a portion where the first ascending/descending connection part 73 adjoins the moving rack 70 becomes greater.

As an example structure for the ascending and descending of a moving rack 70, a driving force of ascending and descending the moving rack 70 is separately delivered, and the first ascending/descending connection part 73 and the second ascending/descending connection part 74 may be configured to be guided by the first ascending/descending guide part 51 and the second ascending/descending guide part 52 so as to move upward and downward.

In the present disclosure, the first ascending/descending guide part 51 and the second ascending/descending guide part 52 are configured as a first ball screw and a second ball screw, and the first ascending/descending connection part 73 and the second ascending/descending connection part 74 are configured as a first ball nut and a second ball nut that are coupled to the first ball screw and second ball screw. Accordingly, the first ball screw 51 and second ball screw 52 rotate so as to drive and simultaneously guide the ascending and descending of the moving rack 70. The ascending and descending of the moving rack 70 may be driven and guided at the same time by the ball screws. Thus, an ascending/descending structure of a tray may be easily implemented.

One end (e.g., an upper end) of the first ball screw 51 and second ball screw 52 may be rotatably supported by a support 53 provided in the cavity rear panel 37. The other end (lower end) of the first ball screw 51 and second ball screw 52 may be directly connected to the rotational shaft of a motor and supported or indirectly connected to the rotational shaft of a motor through a speed reducer, and the like and supported.

The first ball screw and the second ball screw on the left side may be configured to be rotated by one motor while the first ball screw and the second ball screw on the right side may be configured to be rotated by another motor.

The first ball screw 51 and the second ball screw 52 are supported by the support 53 fixed to the cavity rear panel 37, the moving rack 70 is supported by the first ascending/descending guide part 51 and the second ascending/descending guide part 52, and the rear panel is fixed to the cavity rear panel by a spacer. Accordingly, the first ball screw 51, the second ball screw 52, the support 53, the cavity rear panel 37, the first ascending/descending guide part 51 and the second ascending/descending guide part 52 are modularized so as to implement an ascending/descending structure.

The first ascending/descending guide part 51 and the second ascending/descending guide part 52 may not be affected by heated air because the first ascending/descending guide part 51 and the second ascending/descending guide part 52 are placed close to the first tray frame connecting part and away from the central air hole.

The lower portion of the moving rack 70 may interfere with the cavity rear panel 37 via a moment applied by the first tray 88 in a way that pressurizes the front surface of the cavity rear panel 37 backward.

In some implementations, a first ascending/descending guider 375 with the shape of a rail that extends in the up-down direction may be formed at the rear of a portion between the first ascending/descending guide part 51 and the second ascending/descending guide part 52, on the front surface of the cavity rear panel, and a second ascending/descending guider 78 that has a groove shape, that contacts the rail 375 and that is guided by the rail so as to ascend and descend may be formed on the rear surface of the moving rack 70. The additional guide structure is provided so as to guide upward and downward movements and to additionally apply a support structure of a moment that is applied to the moving rack 70 by the first tray 88, to the cavity rear panel 37. Accordingly, the additional guide structure may support the first tray 88 even when a heavy load of food is placed on the first tray 88 supported with a cantilever structure. The shape of the second ascending/descending guider 78 is not limited to the shape of a groove that is placed in the rail and may further include a roller structure that can effectively support load acting in the front-rear direction and guide upward and backward movements, and the like.

The rear cover 40 may further include an inclined surface part 43 corresponding to the structure of the moving rack 70, both end portions of which protrude forward because of the bent part 77. The rear cover 40 is placed close to the cross bar 72 of the moving rack 70 while both end portions 41 of the rear cover may protrude further forward than the rear cover through the inclined surface part 43 and may be placed close to the first tray frame connecting part 71. With the structure, a space for cooking food and a space for installing the moving rack 70 and ascending/descending guide parts (51, 52, 53, and the like) relating to the moving rack 70 may be separated, and maximization of space for cooking may be ensured. Additionally, the inclined surface part 43 allows heat in the cavity to flow smoothly.

The cavity rear panel 37 further includes a fixed tray rack 60. The fixed tray rack 60 is fixed to the cavity rear panel 37 and provided with a plurality of fitting holes 61 that are spaced a predetermined distance apart in the up-down direction. In the implementations, the fixed tray rack includes four fitting holes 61.

Each fitting hole 61 includes an upper fitting hole 611 having the shape of a long hole that is open in the up-down direction and a lower fitting hole 612 having the shape of a round hole and provided in the lower portion of the upper fitting hole. The shapes of the upper and lower fitting holes may be substantially the same as those of the fitting holes 71 of the moving rack 70.

The fitting hole 61 of the fixed tray rack 60 is also spaced a predetermined distance apart from the cavity rear panel 37. The fixed tray rack 60 is a structure in which a second tray frame 90 of a second tray 98 is additionally installed when two or more trays are installed in the cavity.

The fitting hole 61 of the fixed tray rack 60 may be placed in a position corresponding to the position of the fitting hole 71 of the moving rack 70. In some examples, there may be a predetermined gap between members that include two fitting holes 61, 71 in order for the moving rack 70 and the first tray frame to be assembled. Accordingly, when a distance between left and right fitting holes 61 is matched with a distance between left and right fitting holes 71, the second tray and the second tray frame may be substantially the same as the first tray and the first tray frame.

Figure 11:
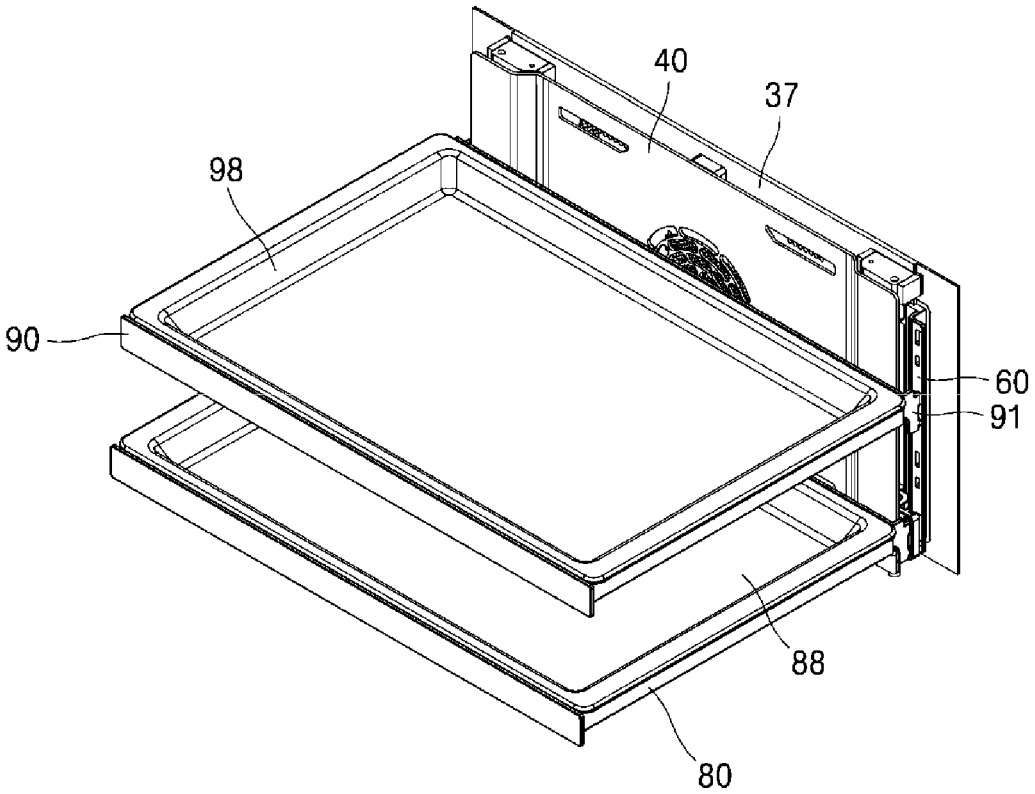
FIG. 11 is a perspective view illustrating an example additional tray frame that is installed at a fixed tray rack in FIG. 4.
Figure 12:
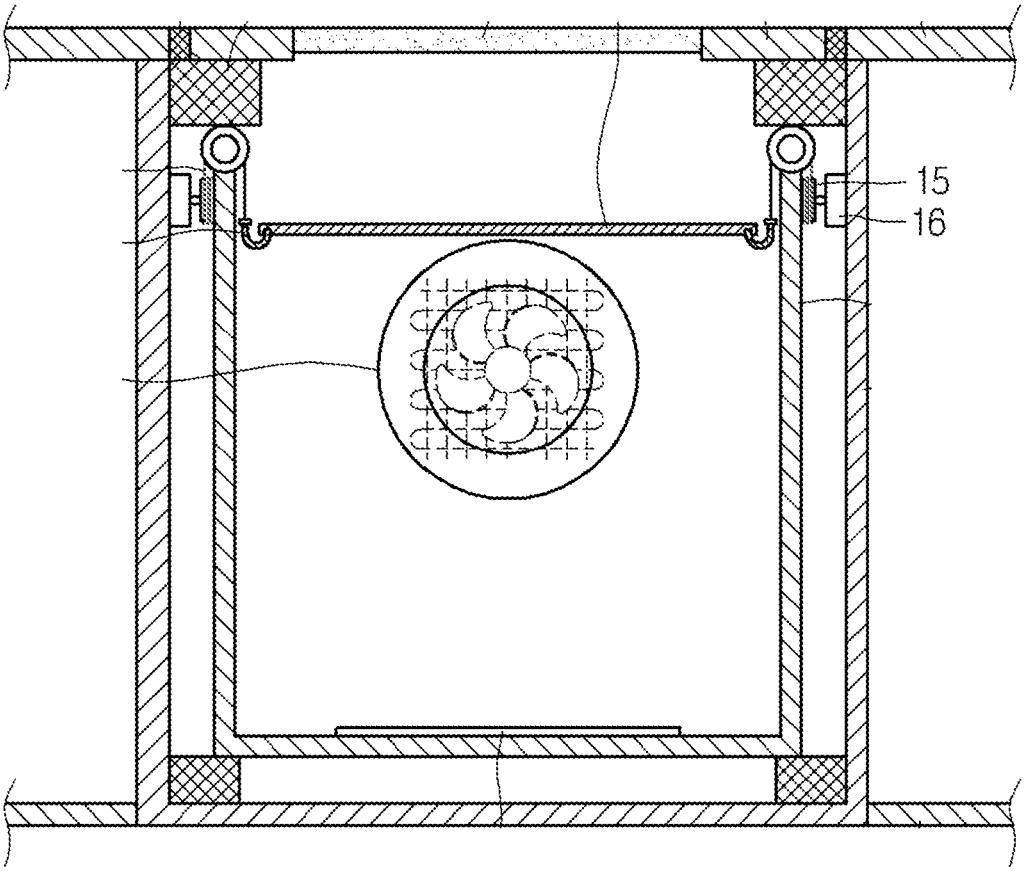
FIG. 12 RELATED ART
FIG. 12 is a view illustrating an example structure for ascending and descending a tray in an oven in related art.

The fixed tray rack 60 may have a structure configured to support two or more tray frames 80, 90 installed in the cavity as shown in FIG. 11.

Figure 10:
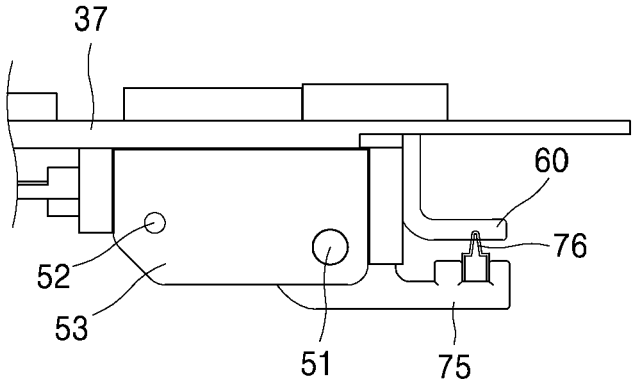
FIG. 10 is an enlarged plan view illustrating an example of a fixing member installed in the moving rack in FIG. 9 that is coupled to an example fixed tray rack.

In some implementations, the fixed tray rack 60 has a structure where the moving rack 70 may be temporarily fixed. As shown in FIG. 10, a temporary fixation member 76 such as a leaf spring is provided at the rear of the fitting hole 71 of the moving rack 70, and, when the moving rack 70 ascends to a predetermined height, and the temporary fixation member 76 is fitted into the fitting hole 61, the moving rack 70 may stay stably in a position at the height. The temporary fixation member 76 may be installed not to interfere with a rack coupling part 81 of the first tray frame.

In the above-described structure of the moving rack, structures such as the fixed tray rack 60, the first tray frame connecting part 71, the ascending/descending connection parts 73, 74 require a predetermined space in the forward direction of the cavity rear panel. The structures are placed in both end portions of the cavity rear panel. Thus, a structure that is added to automatically ascend and descend the first tray takes up little space in the cavity.

The present disclosure has been described with reference to the attached drawings. However, the present disclosure is not limited to the implementations and drawings set forth herein but may be modified in various forms by one having ordinary skill in the art within the scope of the technical spirit of the disclosure. Further, even though effects of the configurations of the disclosure are not explicitly described in the description of the implementations, expected effects in relation to the configurations should be included in the scope of the disclosure.

What is claimed is:

1. An oven comprising:

a rear panel that defines at least a portion of a cavity of the oven and that is located at a rear side of the cavity;

a first tray frame configured to support an oven tray located in the cavity;

a guide that is located at a front surface of the rear panel at lateral sides of the rear panel;

a moving rack comprising a guide connector configured to engage with the guide and a first frame connector configured to connect to the first tray frame, the moving rack being configured to move up and down along the guide; and a rear cover that is located between the oven tray and the rear panel and that covers the guide and the guide connector, wherein the moving rack extends toward the lateral sides of the rear panel in a space defined between the rear cover and the rear panel, and the first frame connector is exposed laterally outside of the rear cover.

2. The oven of claim 1, wherein the first frame connector is disposed laterally outward relative to the guide.

3. The oven of claim 1, wherein the guide comprises a ball screw that extends in a vertical direction, the ball screw having a first end connected to a driving device configured to rotate the ball screw and a second end connected to a support configured to rotatably support the ball screw, and wherein the guide connector comprises a ball nut configured to engage with the ball screw.

4. The oven of claim 3, wherein the support is fixed to the rear panel.

5. The oven of claim 1, wherein the guide comprises:

a first guide that is located laterally inward of the first frame connector; and a second guide that is located laterally inward of the first guide and that is located rearward of the first guide toward the rear panel.

6. The oven of claim 5, wherein the rear cover comprises:

a plate portion that extends in a direction parallel to the rear panel; and an inclined portion that is inclined relative to the plate portion, that extends in a direction forward and laterally outward from the plate portion, and that covers the first guide and the second guide.

7. The oven of claim 1, wherein the first frame connector comprises a pair of connectors that are located at lateral sides of the moving rack, wherein the moving rack further comprises a cross bar that extends between the pair of connectors in a lateral direction and that is connected to the pair of connectors, and wherein the rear cover covers the cross bar of the moving rack.

8. The oven of claim 7, wherein the rear panel defines panel air holes, and wherein the rear cover defines cover air holes at positions corresponding to the panel air holes.

9. The oven of claim 1, further comprising a spacer located between the rear cover and the rear panel and configured to couple the rear cover to the rear panel.

10. The oven of claim 1, wherein the rear panel comprises a first guider that extends in a vertical direction and that is located at the front surface of the rear panel, and wherein the moving rack comprises a second guider that is configured to move in the vertical direction along the first guider.

11. The oven of claim 10, wherein the first guider is located rearward of the guide.

12. The oven of claim 1, wherein the first frame connector is located forward of the rear panel and spaced apart from the rear panel by a predetermined distance, and wherein the oven further comprises a fixed tray rack located between the rear panel and the first frame connector.

13. The oven of claim 12, wherein the fixed tray rack is fixed to the rear panel, at least a portion of the fixed tray rack being spaced apart from the rear panel and the first frame connector.

14. The oven of claim 12, wherein the fixed tray rack comprises a second frame connector that is configured to detachably connect to a second tray frame and that is configured to support the second tray frame at predetermined positions that are spaced apart in a vertical direction.

15. The oven of claim 14, wherein the second frame connector defines fitting holes and is located rearward of the first frame connector, and wherein the first frame connector comprises a fixation member that extends rearward and that is configured to couple to the fitting holes of the second frame connector.

16. A rear panel of an oven located at a rear side of a cavity of the oven, the rear panel comprising:

a guide that is connected to the rear panel and that is located at a front surface of the rear panel at lateral sides of the rear panel;

a moving rack comprising a frame connector configured to connect to an oven tray and a guide connector configured to engage with the guide, the moving rack being configured to move up and down along the guide; and a rear cover that is connected to the rear panel and that covers a front side of the guide and the guide connector, wherein the moving rack extends toward the lateral sides of the rear panel in a space defined between the rear cover and the rear panel, and the frame connector is exposed laterally outside of the rear cover.

17. The rear panel of claim 16, further comprising a first guider that extends in a vertical direction, that is located at the front surface of the rear panel, and that is located rearward of the guide, wherein the moving rack further comprises a second guider that is configured to move in the vertical direction along the first guider.

18. The rear panel of claim 16, wherein the guide comprises:

a first guide that is located laterally inward of the frame connector; and a second guide that is located laterally inward of the first guide and that is located rearward of the first guide toward the rear panel.

19. The rear panel of claim 16, wherein the frame connector comprises a pair of connectors that are located at lateral sides of the moving rack, wherein the moving rack further comprises a cross bar that extends between the pair of connectors in a lateral direction and that is connected to the pair of connectors, and wherein the rear cover covers the cross bar of the moving rack.

20. The rear panel of claim 16, wherein the frame connector is located forward of the rear panel and spaced apart from the rear panel by a predetermined distance, and wherein the rear panel is located rearward of a fixed tray rack that is located rearward of the frame connector.

* * * * *